US007299886B2

(12) United States Patent
Wenzel

(10) Patent No.: US 7,299,886 B2
(45) Date of Patent: Nov. 27, 2007

(54) STABILIZED DOWN HOLE DRILLING MOTOR

(76) Inventor: William Ray Wenzel, 1738 Kensit Place, Edmonton, Alberta (CA) T6L 6X7

( * ) Notice: Subject to any disclaimer, the term of this patent is extended or adjusted under 35 U.S.C. 154(b) by 0 days.

(21) Appl. No.: 11/353,865

(22) Filed: Feb. 14, 2006

(65) Prior Publication Data

US 2006/0191720 A1 Aug. 31, 2006

Related U.S. Application Data

(63) Continuation-in-part of application No. 10/770,710, filed on Feb. 3, 2004, now abandoned.

(30) Foreign Application Priority Data

Sep. 2, 2003 (CA) ..... 2439331

(51) Int. Cl.
*E21B 4/02* (2006.01)
*E21B 17/10* (2006.01)

(52) U.S. Cl. ..... 175/107; 175/325.5; 175/92; 166/241.6

(58) Field of Classification Search ..... 175/92, 175/107, 320, 325.1, 325.2, 325.5; 166/241.6
See application file for complete search history.

(56) References Cited

U.S. PATENT DOCUMENTS 3,063,759 A 11/1962 Moore et al.
3,088,529 A 5/1963 Cullen et al.
3,146,611 A 9/1964 Fox
3,267,695 A 8/1966 Toelke
3,343,615 A 9/1967 Terry
3,419,094 A 12/1968 Bobo
3,561,549 A 2/1971 Garrison et al.
3,762,472 A 10/1973 Alexander, Jr.
4,011,917 A * 3/1977 Tiraspolsky et al. ..... 175/107
4,319,649 A 3/1982 Jeter
4,384,626 A 5/1983 Derouin
4,492,276 A 1/1985 Kamp
4,560,013 A 12/1985 Beimgraben
4,792,000 A 12/1988 Perkin et al.
4,862,974 A 9/1989 Warren et al.
4,877,092 A * 10/1989 Helm et al. ..... 175/74
5,165,492 A * 11/1992 Beasley ..... 175/107
6,349,779 B1 2/2002 Gilbert
6,640,910 B2 11/2003 Grupping (Continued)

FOREIGN PATENT DOCUMENTS

GB 2 059 481 A 4/1981

*Primary Examiner*—Kenneth Thompson
*Assistant Examiner*—Shane Bomar
(74) *Attorney, Agent, or Firm*—Christensen O'Connor Johnson Kindness PLLC

(57) ABSTRACT

A down hole drilling motor includes a stator housing having an exterior surface, an upper end, a lower end, an upper vane mounting region at the upper end and lower vane mounting region at the lower end. An upper mounting sleeve engages the upper vane mounting region, such that rotation during use brings the upper mounting sleeve into contact with an upper contact shoulder. A lower mounting sleeve engages the lower vane mounting region, such that rotation during use brings the lower mounting sleeve into contact with a lower contact shoulder. A plurality of vanes are secured to each of the upper mounting sleeve and the lower mounting sleeve.

3 Claims, 4 Drawing Sheets

U.S. PATENT DOCUMENTS 6,722,453 B1 4/2004 Crooks
2003/0221872 A1 12/2003 Boulet
2005/0183864 A1 8/2005 Trinder et al.

* cited by examiner

STABILIZED DOWN HOLE DRILLING MOTOR

CROSS-REFERENCE TO RELATED APPLICATION

This application is a continuation-in-part of application Ser. No. 10/770,710, filed Feb. 3, 2004 now abandoned, which is incorporated by reference herein.

FIELD OF THE INVENTION

The present invention relates to a down hole drilling motor which has been modified by the inclusion of stabilizing vanes.

BACKGROUND

A complete downhole drilling motor is typically in excess of 15 feet in length. When drilling with a downhole drilling motor, some flexing of the downhole drilling motor occurs. This flexing is undesirable, as it may cause excessive wear of the stator and undesirable deviation of the wellbore. In order to reduce this flexing and protect the drilling motor, stabilizers are placed both above and below the drilling motor.

U.S. Pat. No. 3,088,529 (Cullen 1963) and U.S. Pat. No. 4,492,276 (Kamp 1985) disclose down hole motors that have stabilizing vanes.

SUMMARY

According to the present invention there is provided a down hole drilling motor which includes a stator housing having an exterior surface, an upper end and a lower end. The exterior surface has an upper vane mounting region at the upper end on which are positioned left hand threads. The upper vane mounting region terminates in an upper contact shoulder which is spaced inwardly from the upper end. A lower vane mounting region is located at the lower end on which are positioned right hand threads. The lower vane mounting region terminates in a lower contact shoulder spaced inwardly from the lower end. An upper mounting sleeve is provide having an internal surface on which are positioned threads adapted to mate with the left hand threads of the upper vane mounting region, such that right hand rotation of the stator housing brings the upper mounting sleeve into contact with the upper contact shoulder. A lower mounting sleeve is provided having an internal surface on which are positioned threads adapted to mate with the right hand threads of the lower vane mounting region, such that right hand rotation of the stator housing brings the lower mounting sleeve in contact with the lower contact shoulder. A plurality of vanes are secured at spaced intervals around a circumference of and extend radially from each of the upper mounting sleeve and the lower mounting sleeve. Each of the vanes having a length in relation to a diameter of the upper mounting sleeve and the lower mounting sleeve which is expressed by a length to diameter ratio of between 3 and 5 to 1. The combined upper and lower vane length covers not less than one fifth and not more than two thirds of the length of the stator housing.

DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION

Figure 1:
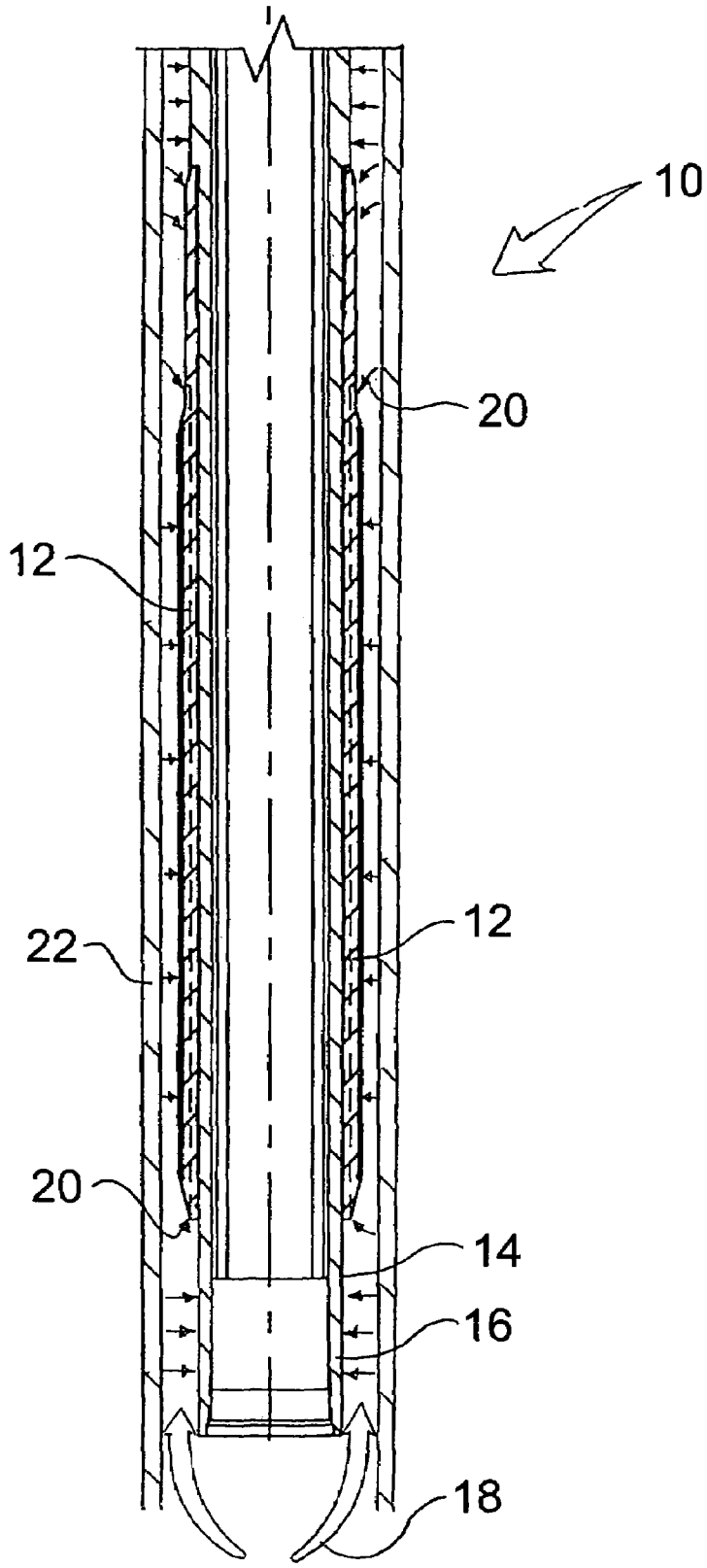
FIG. 1 is a side elevation view, in section, of a drilling motor being used in accordance with the teachings of the present method.

The preferred embodiment, a method of stabilizing a downhole drilling motor and a downhole drilling motor generally identified by reference numeral 10, will now be described with reference to FIGS. 1 through 5.

Figure 2:
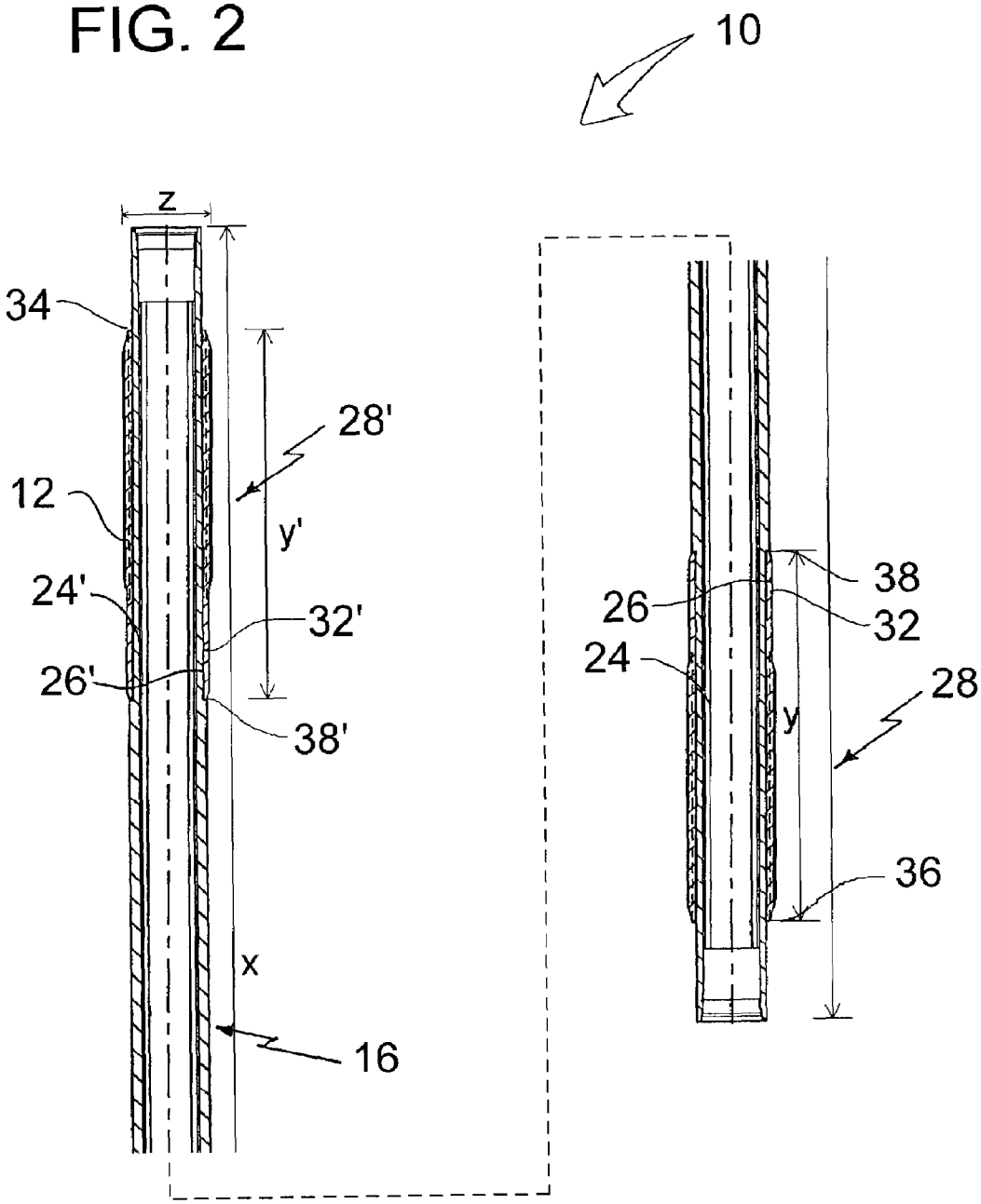
FIG. 2 is a side elevation view, in section, of a drilling motor constructed in accordance with the teachings of the present invention.
Figure 3:
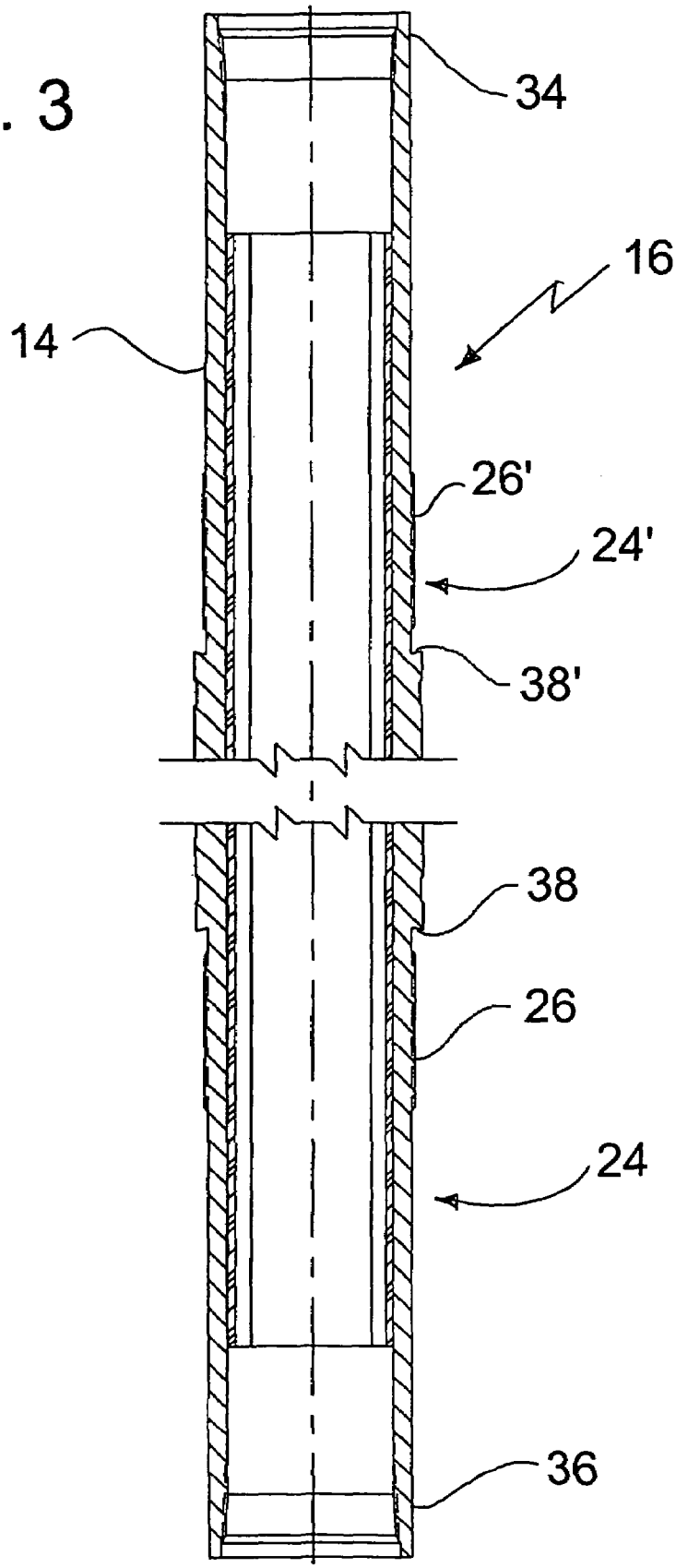
FIG. 3 is a side elevation view, in section, of a stator housing from the drilling motor illustrated in FIG. 2.
Figure 4:
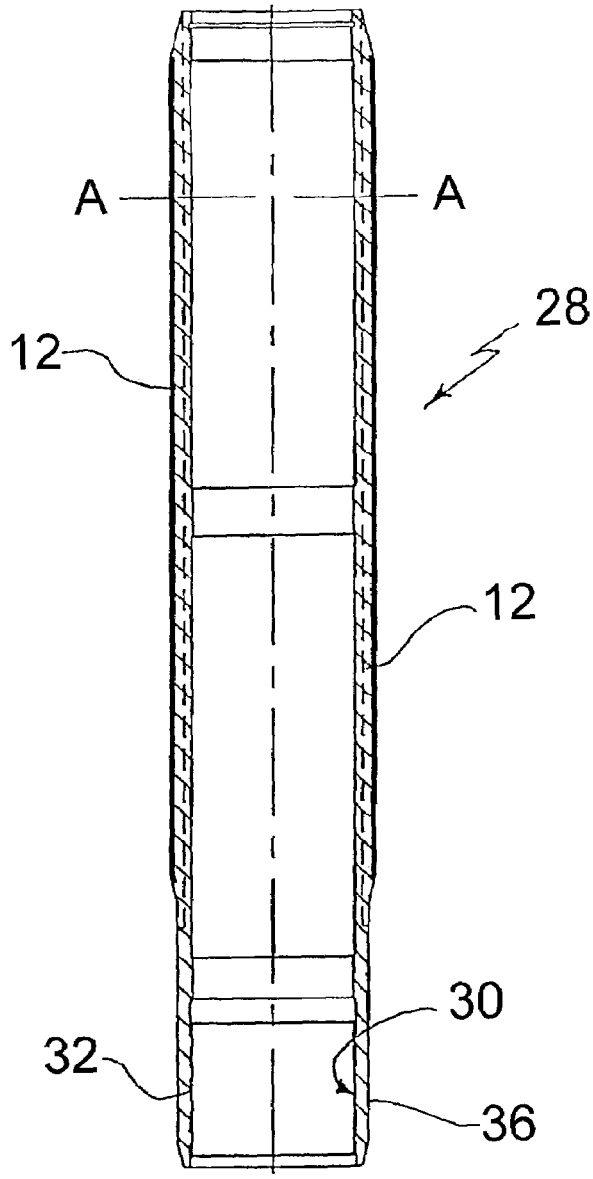
FIG. 4 is a side elevation view, in section, of a mounting sleeve from the drilling motor illustrated in FIG. 2.

Structure and Relationship of Parts:

Referring to FIG. 1, a first step involves providing a drilling motor 10 and securing a plurality of vanes 12 to an exterior surface 14 of a stator housing 16. A second step involves passing a flow of drilling fluids 18 past exterior surface 14 of stator housing 16 between vanes 12. As a result of steps one and two, the clearance between the outermost extremity of the vanes and the well bore is reduced which in turn reduces the tendency for the well bore to deviate. Referring to FIG. 3, exterior surface 14 of stator housing 16 has a vane mounting region 24 on which are positioned threads, hereinafter referred to as stator threads 26. Referring to FIG. 4, vanes 12 are secured to mounting sleeves 28, each mounting sleeve 28 having an internal surface 30 upon which are positioned threads, hereinafter referred to as sleeve threads 32. Referring to FIG. 2, sleeve threads 32 are coupled with stator threads 26 of vane mounting region 24 so as to secure vanes 12 in position.

Figure 5:
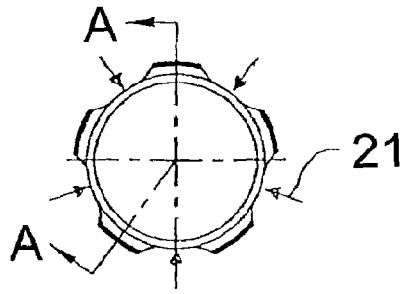
FIG. 5 is an end elevation view, in section, of the mounting sleeve illustrated in FIG. 4.

Operation:

The method of stabilizing a downhole drilling motor and the use and operation of a downhole drilling motor will now be described with reference to FIGS. 1 through 5. Referring to FIG. 3, stator housing 16 is adapted with stator threads 26. Referring to FIG. 4, mounting sleeve 28 is adapted with vanes 12. Referring to FIG. 2, mounting sleeves 28, adapted with sleeve threads 32 are coupled to stator 16 at stator threads 26, securing vanes 12 in position. Referring to FIG. 1, assembled downhole drilling motor 10 is then positioned in well string 22. Flow of drilling fluids 18 is passed into well bore 22 and a region of higher velocity drilling fluid 20 is created. Referring to FIG. 5, well bore clearance 21 is reduced such that flexing of downhole drilling motor 10 which might otherwise lead to well bore deviation, is minimized.

The preferred embodiment will now be described in greater detail. Referring to FIG. 3, downhole drilling motor 10 includes a stator housing 16 having an exterior surface 14, an upper end 34 and a lower end 36. Exterior surface 14 has an upper vane mounting region 24' at upper end 34 and a lower vane mounting region 24 at lower end 36. Upper vane mounting region 24' terminates in an upper contact shoulder 38' spaced inwardly from upper end 34 and has left hand threads 26' positioned on it. Lower vane mounting region 24 terminates in a lower contact shoulder 38 at lower end 36 and has right hand threads 26 positioned on it. Referring to FIG. 2, there is an upper mounting sleeve 28' and a lower mounting sleeve 28. Upper mounting sleeve 28' has an internal surface 30' on which are positioned threads 32' adapted to mate with left hand threads 26' of upper vane mounting region 24', such that right hand rotation of stator housing 16 brings upper mounting sleeve 28' into contact with upper contact shoulder 38'. Similarly, lower mounting sleeve 28 has an internal surface 30 on which are positioned threads 32 adapted to mate with right hand threads 26 of lower vane mounting region 24, such that right hand rotation of stator housing 16 brings lower mounting sleeve 28 in contact with lower contact shoulder 38. Referring to FIGS. 4 and 5, a plurality of vanes 12 are secured at spaced intervals around the circumference of, and extending radially from lower mounting sleeve 28, as well as upper mounting sleeve 28' (not shown). Each vane 12 has a length y and y' in relation to the diameter z of upper mounting sleeve 28' and lower mounting sleeve 28, which is expressed by a length to diameter ratio of between 3 to 1 and 5 to 1. Vanes 12 cover not less than one fifth and not more than two thirds of the length x of stator housing 16.

Cautionary Notes:

As a result of a number of failures and other tests with less than satisfactory performance, the following:

Threads—It is important that the upper mounting sleeve have a left hand thread and the lower mounting sleeve have a right hand thread. If this is not the case, right hand rotation will loosen either or both mounting sleeves and cause either or both mounting sleeves to detach.

Length of Vanes—The length of the vanes is expressed in terms of a proportion of the overall length of the stator housing. It is important the vanes not be too long. If the vanes are tool long, too much friction is created. In testing four tools became stuck and had to be abandoned down hole. Similarly, it is important that the vanes not be too short. If the vanes are too short, there is not sufficient contact to prevent deviation. It has been found that the vanes should cover not less than one fifth and not more than two thirds of a length of the stator housing. It has also been determined that the length of the vanes can be calculated having reference to the diameter to the mounting sleeves. A length to diameter ratio of between 3 and 5 to 1 has been found to be appropriate.

Number of Vanes—Although some success was obtained with different number of vanes, it was found that an odd number of vanes was less likely to get stuck and that five vanes appeared to be optimum. It is believed that the reason five vanes are to be preferred is that it resulted in an unequal force distribution.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the claims.

The invention claimed is:

1. A down hole drilling motor, comprising:

a stator housing having an exterior surface, an upper end and a lower end, the exterior surface having an upper vane mounting region at the upper end on which are positioned left hand threads, the upper vane mounting region terminating in an upper contact shoulder spaced inwardly from the upper end and a lower vane mounting region at the lower end on which are positioned right hand threads, the lower vane mounting region terminating in a lower contact shoulder spaced inwardly from the lower end;

an upper mounting sleeve having an internal surface on which are positioned threads adapted to mate with the left hand threads of the upper vane mounting region, such that right hand rotation of the stator housing brings the upper mounting sleeve into contact with the upper contact shoulder;

a lower mounting sleeve having an internal surface on which are positioned threads adapted to mate with the right hand threads of the lower vane mounting region, such that right hand rotation of the stator housing brings the lower mounting sleeve in contact with the lower contact shoulder; and a plurality of vanes being secured at spaced intervals around a circumference of and extending radially from each of the upper mounting sleeve and the lower mounting sleeve, each of the vanes having a length in relation to an outer diameter of the upper mounting sleeve and the lower mounting sleeve which is expressed by a length to diameter ratio of between 3 and 5 to 1, the combined upper and lower vane length covering not less than one fifth and not more than two thirds of the length of the stator housing.

2. The down hole drilling motor as defined in claim 1, wherein there are an odd number of vanes spaced circumferentially around each of the upper mounting sleeve and the lower mounting sleeve.

3. The down hole drilling motor as defined in claim 2, wherein there are five vanes.

* * * * *